United States Patent [19]

Krenz

[11] 4,047,745

[45] Sept. 13, 1977

[54] RELEASABLE LATCH ASSEMBLY

[75] Inventor: Joseph H. Krenz, Warsaw, Ind.

[73] Assignee: Sun Metal Products, Inc., Warsaw, Ind.

[21] Appl. No.: 725,469

[22] Filed: Sept. 22, 1976

[51] Int. Cl.[2] ..... E05C 19/18

[52] U.S. Cl. ..... 292/302

[58] Field of Search ..... 292/302, 256.63, 256.65, 292/343, DIG. 32, 288

[56] References Cited

U.S. PATENT DOCUMENTS 3,869,162 3/1975 Schuller ..... 292/302 X

FOREIGN PATENT DOCUMENTS 462,068 3/1937 United Kingdom ..... 292/302

*Primary Examiner*—Richard E. Moore

*Attorney, Agent, or Firm*—Watson, Cole, Grindle & Watson

[57] ABSTRACT

A latch assembly for connecting adjacent parts together in angular relationship to one another, includes interengaged latch elements having aligned and elongated openings therein respectively sloping inwardly toward one another. A latch pin having an elongated cross-sectional width extends through the aligned openings to thereby effectively resist forces tending to pull the latch elements apart.

10 Claims, 8 Drawing Figures

RELEASABLE LATCH ASSEMBLY

BACKGROUND OF THE INVENTION

This invention relates generally to a releasable latch assembly, and more particularly to such an assembly for use in latching together ends of a tobacco container side wall to easily facilitate opening and reclosing of the container for inspection and to further render the container collapsible.

As discussed in a related and commonly owned U.S. patent application Ser. No. 660,224, filed Feb. 23, 1976, prior art containers designed for exporting leaf tobacco are made of wooden stays assembled together in flat mats of a sufficient number to form a container of a predetermined size. The problems with such container constructions prevail in that, when inspecting the tobacco just prior to final shipment thereof for export, an opening is normally made in one of the container stays thereby requiring repair of the opening which is not only time consuming but adds to the cost of labor and materials. Moreover, the manufacturer of these prior art containers requires skilled labor which is oftentimes unavailable and quite costly.

As further discussed in the aforementioned related application, leaf tobacco containers designed for domestic use are similarly designed as those for export except that the domestic use containers are of smaller size and are made collapsible and reuseable. Also, removable hinge pins of a standard hinge assembly are provided for the smaller containers so as to permit disassembly of the hinge pins for collapse of the container. However, these hinge pins are easily lost and the hinge assemblies are bulky and costly thereby adding to the cost of manufacture of the domestic use containers. And, the hinge pins are sometimes weakened throughout extended use because of their particular design.

The present invention represents another approach taken, as compared to the invention under the aforementioned application, in solving the noted problems of the prior art.

OBJECTS OF THE INVENTION

It is an object of the present invention to provide a releasable latch assembly which is simple in construction, easy to manufacture, simple to use and economical yet highly effective in locking together adjacent parts of a container side wall, for example.

Another object of the invention is to provide such a latch assembly as comprising a pair of rigid latch members having overlapping flanges containing elongated openings sloping in opposite directions and being axially aligned for the reception of a hinge pin which is likewise elongated at its cross-sectional width. Upon engagement of the hinge pin with the aligned openings, the latch members are made to lie at an angle to one another for use in latching together side walls not lying in a common plane. Also, because of the cross-sectional design of the pin member, any forces tending to pull the latch elements apart are thereby strongly resisted. And, a protuberance may be provided on the pin member for frictional engagement with a wall of the openings so as to thereby maintain the pin member securely in place.

Other objects, advantages and novel features of the invention will become more apparent from the following detailed description of the invention when taken in conjunction with the present drawings.

DETAILED DESCRIPTION OF THE INVENTION

Figure 1:
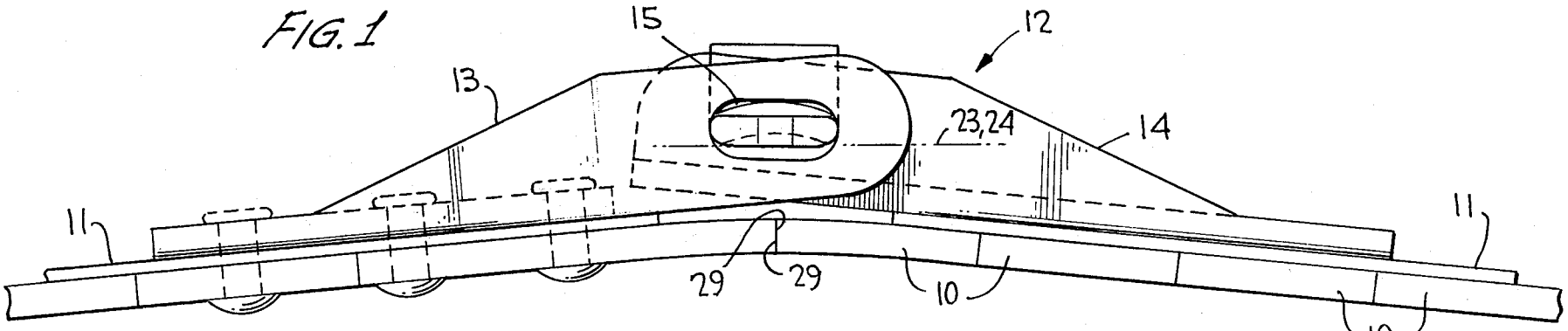
FIG. 1 is a sectional view taken through a container with the present latch assembly being engaged and mounted thereon.

Turning now to the drawings wherein like reference characters refer to like and corresponding parts throughout the several views, a transverse sectional view taken through wooden stays 10 of a container which may be usable for tobacco leaves for either export or domestic use, is illustrated in FIG. 1 without otherwise showing the remainder of the container although it clearly appears in FIG. 1 of the aforementioned related application. The wooden stays are held together by means of metal bands 11 secured to the stays near opposite ends thereof, although only a part of one such band is shown in FIG. 1.

Figure 3:
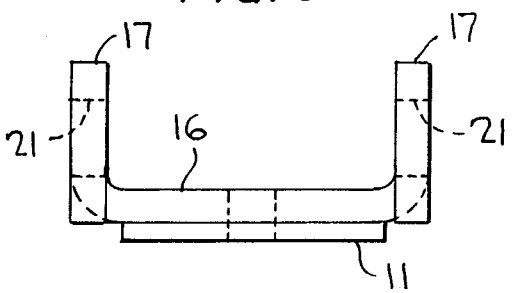
FIG. 3 is an end elevational view of the latch member of FIG. 2.
Figure 2:
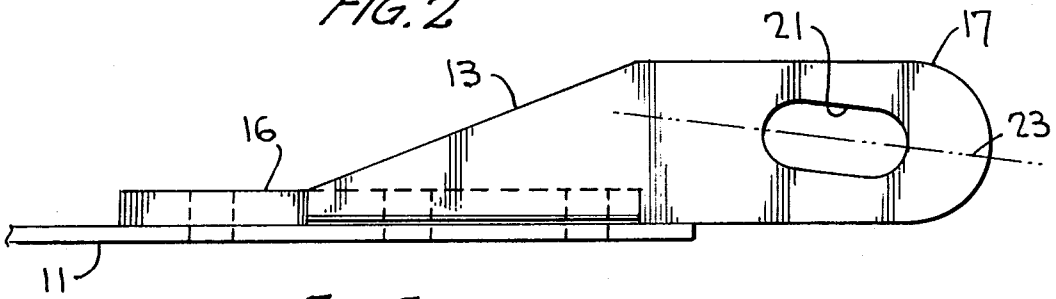
FIG. 2 is a side elevational view of one latch member of the present latch assembly.

The releasable latch assembly of the invention is generally designated 12 and comprises interengaged latch members 13 and 14 and a pin member 15. Latch member 13 is of a rigid metal construction having a base plate 16 riveted or otherwise secured to one end of band 11 as shown in FIG. 2. The latch member extends slightly outwardly of the free end of the band, and further comprises a pair of spaced flanges 17 extending outwardly of the base plate. Member 13 is therefore substantially U-shaped in cross-section as shown in FIG. 3 with the outer surfaces of the flanges being spaced apart a predetermined distance.

Figure 4:
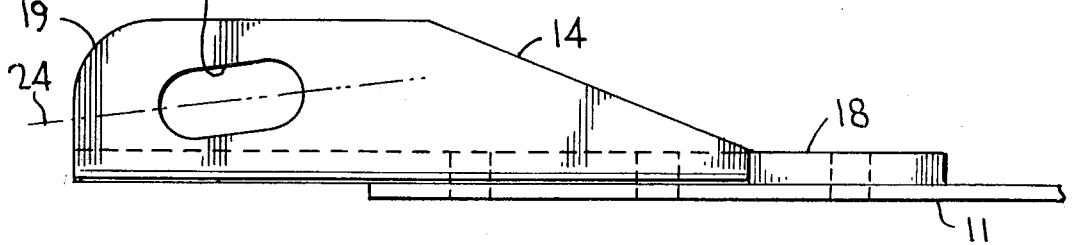
FIG. 4 is a side elevational view of another latch member of the present latch assembly.
Figure 5:
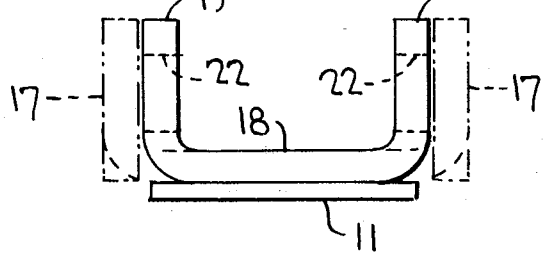
FIG. 5 is an end elevational view of the latch member of FIG. 4.

Latch member 14, similar in design to latch member 13, includes a base plate 18 capable of being riveted or otherwise secured to the opposite end of band 11 as shown in FIG. 4. A pair of spaced flanges 19 extend outwardly of base plate 18 and, as shown in FIG. 5, latch member 14 is substantially U-shaped in cross-section. However, the outer walls of flanges 19 are spaced apart a distance substantially equal to the spacing between the inner walls of flanges 17 so that flanges 19 are completely embraced by flanges 17 as shown in solid and in phantom outline in FIG. 3, and as shown in FIG. 1.

Flanges 17 of latch member 13 are provided with aligned elongated openings 21 which slope toward the plane containing base plate 16 and toward the free end of member 13. Similarly, flanges 19 of member 14 are provided with aligned elongated openings 22 which slope toward a plane in which base plate 18 lies and further toward the free end of latch member 14. Axis lines 23 and 24 along which the respective openings lie may be disposed at approximately 4° from the planes in which their respective base plates 16 and 18 lie. And, when lines 23 and 24 are made coincident upon nesting engagement of flanges 17 and 19, base plates 16 and 18 of the latch members are made to lie at an angle relative to one another as shown in FIG. 1. Also, when openings 21 and 22 are disposed in full axial alignment in such an arrangement, pin member 15 may be extended through the aligned openings for securing the latch members together.

Figure 6:
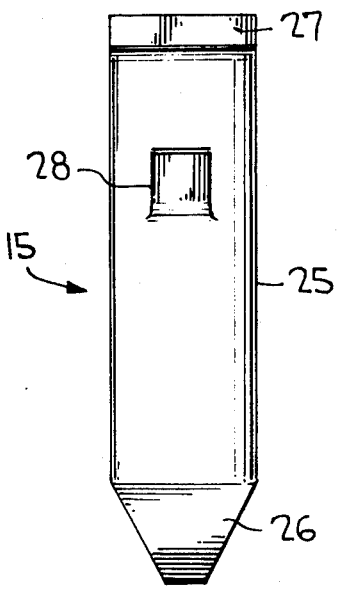
FIGS. 6 and 7 are respectively side elevational and end elevational views of a pin member provided for the latch assembly.
Figure 7:
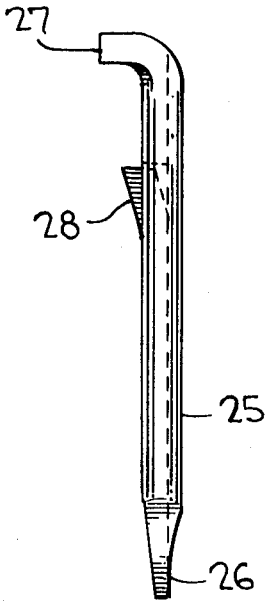
Figure 8:
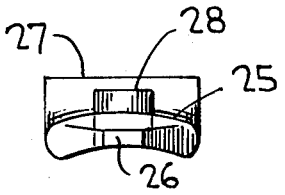
FIG. 8 is a bottom view taken of the pin member of FIG. 6.

The pin member as shown in FIGS. 6 and 7 comprises a metallic shank portion 25 having a pointed end 26 to facilitate insertion of the pin member within the aligned openings. A bent flange 27 is provided on shank 25 of the pin member to facilitate ease in handling thereof and to prevent the pin member from falling out of the aligned openings. Also, a protuberance 28 may be provided in the shank and extends in the same direction as flange 27 so as to frictionally engage with a wall of the aligned openings for securing the pin member in place. Shank 25 of the pin member is elongated in a widthwise direction of substantially the same size as the length of openings 21 and 22. Also, shank 25 is convexly curved as shown in FIG. 8 so that, when it is inserted in place as shown in FIG. 1, it facilitates angular movement between the latch members in a direction of the curved shank which has its convexly curved surface facing away from the base plates of the latch members as shown. Therefore, when the flanges of both latch members are nested together and the latch members are angularly related until lines 23 and 24 are coincident, the pin member may be inserted through openings 21 and 22 which are now axially aligned so as to effectively resist forces tending to separate the latch members along the coincident lines.

From the foregoing, it can be seen that a simple and economical yet highly effective latch assembly has been provided wherein the rigid latch members may be angularly disposed to facilitate the latching of a band surrounding a cylindrical container, and at the same time offers strong resistance to forces tending to separate the latch members by reason of the unique cross-section of the pin member. Removal of the pin member therefore facilitates opening of the container as edges 29 thereof are moved outwardly of one another for inspection of the container contents. Also, the container is rendered collapsible since the latch assemblies thereof may be simply disengaged upon removal of their pin members if desired.

Obviously, many modifications and variations of the present invention are made possible in the light of the above teachings. It is therefore to be understood that within the scope of the appended claims the invention may be practiced otherwise than as specifically described.

What is claimed is:

1. A latch assembly for releasably connecting adjacent parts together in an angular relationship, comprising a pair of latch elements each of which includes a base plate and at least one flange expending perpendicularly thereto, said flanges having openings elongated along lines respectively sloping toward planes containing said base plates and toward free ends of said flanges, said flanges overlapping at said free ends with said openings in axial alignment, said lines of said openings being coincident when said base plates are disposed at an angle to one another, and a releasable pin member extending through said aligned openings, said pin member having a cross-sectional width extending along said coincident lines, whereby forces tending to separate said latch elements along said coincident lines are strongly resisted by said pin member.

2. The latch assembly according to claim 1, wherein a pair of spaced flanges are located on each of said base plates, each of said flanges having said openings located therein.

3. The latch assembly according to claim 1, wherein said openings are equal in size and said pin member width is of a dimension extending substantially between opposite ends of said openings.

4. The latch assembly according to claim 3, wherein said pin member has a convexly curved cross-section facing away from said base plates.

5. The latch assembly according to claim 1, wherein said pin member has a protuberance extending outwardly near one end thereof, said protuberance frictionally engaging a wall of said openings for retaining said pin member in place within said openings.

6. In a container having end walls and an enclosed side wall, at least one band surrounding said side wall for holding it in place, said band having opposite ends respectively secured to adjacent parts of said side wall for movement of said parts away from one another during an inspection of the contents of the container, a latch assembly comprising a pair of latch elements having base plates securable to said opposite ends of said band, at least one flange on each said base plate extending perpendicular thereto, said flanges being in overlapped relationship and having aligned elongated openings therein respectively extending along lines lying at angles to said base plates, said lines of openings being coincident when said base plates are disposed at an angle to one another, and a releasable pin member extending through said aligned openings, said pin member having a cross-sectional width extending along said coincident lines, whereby forces tending to separate said latch elements along said coincident lines are strongly resisted by said pin member.

7. In a container according to claim 6, wherein a pair of spaced flanges are located on each of said base plates, each of said flanges having said openings located therein.

8. In the container according to claim 6, wherein said openings are equal in size and said pin member width is of a dimension extending substantially between opposite ends of said openings.

9. In the container according to claim 8, wherein said pin member has a convexly curved cross-section facing away from said base plates.

10. In the container according to claim 6, wherein said pin member has a protuberance extending outwardly near one end thereof, said protuberance frictionally engaging a wall of said openings for retaining said pin member in place within said openings.

* * * * *